United States Patent [101]

Arena

[11] 4,052,758

[45] Oct. 11, 1977

[54] HUMAN WASTE DISPOSAL SYSTEM

[76] Inventor: Frank Arena, 624 Southwind Circle, N. Palm Beach, Fla. 33408

[21] Appl. No.: 612,661

[22] Filed: Sept. 12, 1975

[51] Int. Cl.[2] ..... E03D 3/00; E03D 11/00

[52] U.S. Cl. ..... 4/79; 4/DIG. 19

[58] Field of Search ..... 4/9-11, 4/41, 76-80, 97, 102, 115, 120, DIG. 19, 128

[56] References Cited

U.S. PATENT DOCUMENTS

| | | | |
|---|---|---|---|
| 247,210 | 9/1881 | Norton | 4/76 |
| 276,261 | 4/1883 | McGinley | 4/102 |
| 1,021,763 | 4/1912 | Crow | 4/120 |
| 3,035,274 | 5/1962 | Baughman | 4/77 |
| 3,336,602 | 8/1967 | Kubit | 4/97 |
| 3,922,730 | 12/1975 | Kemper | 4/77 X |
| 3,996,628 | 12/1976 | Mollerstedt | 4/76 X |

*Primary Examiner*—Richard E. Aegerter
*Assistant Examiner*—Stuart S. Levy

[57] ABSTRACT

A human waste disposal system including an improved toilet, a transfer system and an intermediate sealing means. The toilet includes a bowl with flushing nozzles that use a minimum amount of fluid or a mixture of fluid as a flushing agent. The bowl has a liquid disposing portion separated from a solid disposing portion. The intermediate sealing means may include a valve means operated by a hydraulic, mechanical or electrical means. The solid transfer means includes a liquid system and a separate solid transfer system. The solid transfer system includes a grinding, material moving mechanism located at the lowermost area of the solid disposing portion of the bowl. The mechanism is positioned on the vertical centerline of the solid disposing portion of the bowl. The mechanism grinds the solid materials and forces or pumps the ground solid material into a solid transfer conduit to store solids in a distant, generally sealed, collecting tank that is open to atmosphere. The material in the collecting tanks may be used as raw materials for fertilizer production purposes.

5 Claims, 2 Drawing Figures

HUMAN WASTE DISPOSAL SYSTEM

BACKGROUND OF THE INVENTION

This invention relates to a new and improved human waste disposal system including an improved toilet utilizing a minimal amount of flushing fluid and having a fluid disposing portion and a separate solid disposing portion. The human waste disposal system includes a transfer system connected to said improved toilet with an intermediate valve means.

In the past, toilets have been designed to utilize oil as a flushing agent as shown in the Roscov U.S. Pat. No. 3,431,563. Also various mechanical driving means have been designed and used in the past, such as shown in the McGary et al U.S. Pat. No. 1,276,784. Many present day toilet and disposal systems have utilized large quantities or excessive quantities of fluid to wash the bowl and transfer the waste material to remote locations. Completely waterless bagging devices have been used to eliminate centralized transfer and collection means for transfering the waste materials to a remote sewage disposal plants.

Present day disposal systems utilizing large quantities of water to carry away human waste to sewage treatment plants, actually compound the problem of treatment, in as much as it takes approximately twenty parts of water to flush one part of waste material. This diluted contaminant mixture of waste material and water is transported to a sewage disposal system through sewers. In the sewer system additional water is added to waste material, thereby further diluting the mixture of waste material and water. The sewage treatment plant must treat this large volume of water through an excessive and inefficient system.

BRIEF DESCRIPTION OF A PREFERRED EMBODIMENT

The present invention relates to a new and improved human waste disposal system having an improved toilet that is connected to a transfer system through an intermediate sealing means. The improved toilet includes a bowl having a forward liquid disposing portion and a separate rearward solid disposing portion for human waste. Around the upper edge of the bowl is connected a plurality of flushing nozzles for spraying the interior surface of the bowl. The nozzles utilize a minimum quantity of a liquid flushing agent. The flushing agent includes water and a detergent material. The intermediate sealing means may be a gate type valve or ball valve that is manually, electrically or hydraulically operated. The gate type valve is normally closed and one side of the gate is exposed at the bottom of the bowl at the bottom of each disposing portion. The valve includes scraping means to scrape at least the upper surface of the gate to remove waste material each time the gate valve is opened. The transfer system includes a liquid waste transfer system and a solid waste transfer system. A grinding mechanism that grinds the solid materials from the solid disposing portion is connected in the entrance of the solid waste transfer system. The grinding mechanism is also the material moving mechanism for moving the ground solid material from an area below the sealing means into a conduit for movement to a distant collection area or disposal area.

The human waste disposal system may include a control system actuated by foot petal in order to open and close the valve means and to initiate and stop the flow of flushing fluids out of the nozzles connected about the inside upper surface of the bowl.

It is an object of this invention to provide a human waste plumbing disposal system separate from the household sink, tub and other washing water plumbing waste systems that may be connected to a leeching field or a separate collection tank for secondary use.

It is an object of this invention to stop contamination of sewage discharge with great quantities of water.

It is another object of this invention to provide a means of conservation of portable water.

It is another object of this invention to prevent contamination of subteranian water and soil.

It is another object of this invention to provide raw material that may be used as fertilizer.

It is another object of this invention to provide vast areas for homebuilding on land that is inaccessible to large sewage transporting systems and are restricted against the use of ordinary septic tanks.

It is another object of this invention to save capital costs of sewage and treatment plants.

Another object of this invention is to provide an economical human waste disposal system.

Another object of this invention is to provide a minimum fluid flushing system through nozzles for human waste having a bowl with a liquid portion separated from a solid portion in order to separately dispose of each type of material in distant collection areas.

Another object of this invention is to provide a flushing blend of water and a formula of a biodegradeable detergent, and other materials such as bacteria inducing agents and scented materials.

Another object of this invention is to provide a grinding and material moving mechanism at the bottom of the solid portion of the toilet bowl in order to grind solid material and transfer said solid material into a conduit for transferring solids to a distant collection area.

In accordance with these and other objects which will be apparent hereinafter, the instant invention will now be described with particular reference to the accompanying drawing.

DESCRIPTION OF A PREFERRED EMBODIMENT

Figure 1:
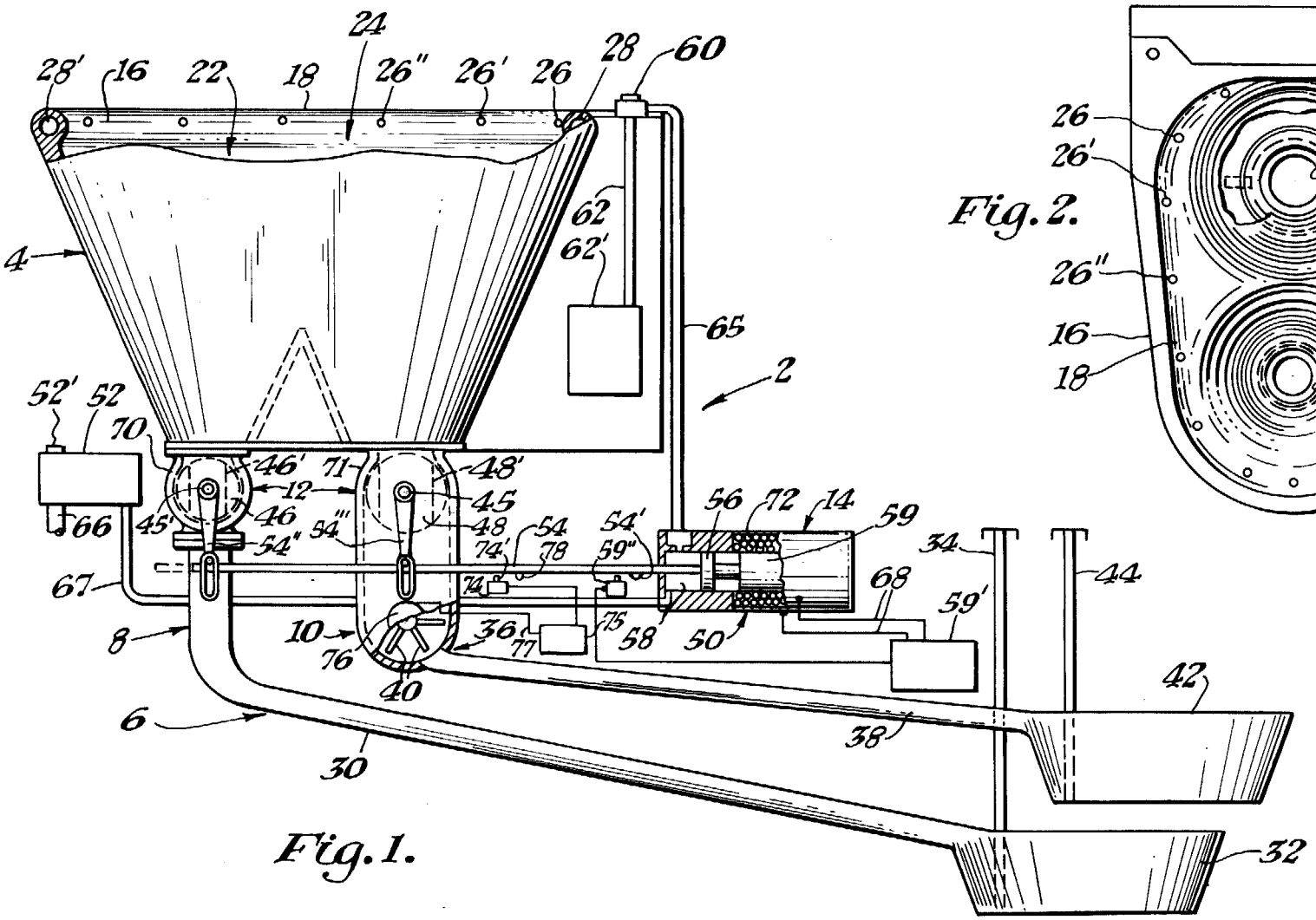
FIG. 1 is a side view partially in cross-section of the human waste disposal system.

Referring now in detail to the drawing, wherein the preferred embodiment of the invention is shown and referring in particular, to FIG. 1, the human waste disposal system is generally designated by numeral 2 and said disposal system includes an improved toilet generally designated by numeral 4, a transfer system generally designated by numeral 6 including a liquid transfer system 8 and a solid transfer system 10, intermediate sealing means 12, and a control system generally designated by numeral 14. The improved toilet 4 includes a bowl 16 having an upper rim 18 and a separating means 20 in the lower portion of the bowl. The separating means 20 provides a forward liquid waste disposing portion 22 and a generally rearward solid waste disposing portion 24. A plurality of nozzles 26, 26', 26'', etc. are spaced around the inner surface of the upper portion of the bowl 16. The nozzles are pointed inwardly to direct a spray of the flushing fluid from line 28 onto the inner furface of the bowl 16. The fluid passing through line 28 to the nozzles may include water and other material as set forth below.

The liquid transfer system 8 includes conduit 30 connected to the liquid waste disposing portion 22 of the bowl 16. The conduit 30 extends from the liquid portion of the bowl 22 to a sealed collection area 32 or storage container 32 having an air vent 34 that provides a conduit into the storage container 32 for the movement of air and other excess materials. The solid transfer system 10 includes a solid conduit 38 with an upper portion designated by numeral 36. The upper portion 36 of the conduit is connected to the solid disposing portion 24 of bowl 16. The grinding and material moving mechanism 40 is located in the upper portion 36 of the solid transfer system. The grinding and material moving mechanism 40 is electrically operated. When rod 54 moves to the left, switch 74 is activated which in turn activates time delay 75 to begin the grinding cycle. The motor 76 is driven through line 77. The lower conduit portion 38 is connected to the upper conduit portion 36. The solid transfer conduit 38 discharges into a second conjunction area or storage container designated by numeral 42. Because of the low volume flushing agent, for example, 8 ounces of flushing agent may be used to flush the system, it is desired that a storage container need by pumped out only twice a year on 2-toilet homes. The second collection area includes an air vent 44 that provides a conduit into the storage container 42 for movement of air and other excess materials. The grinding and transferring mechanism 40 may be a grinding disposal unit such as those used in kitchen sinks including a pump for pumping wetted solid materials. The grinding mechanism may be any grinding mechanism that is well-known in the art. The pumping mechanism may be any well-known pumping mechanism that is known in the art. It should be noted that the grinding and pumping may be done in a combined apparatus. The combined apparatus may include separate grinding and pumping blades and vanes. It should be further understood that the cutting blades and the pumping vanes may be combined into a plurality of vane members that grind and pump.

Between the transfer system 6 and the bowl 16 is a valve means generally designated by numeral 12. The valve means includes a ball valve means 46 and 48. Each ball pivots about arms 45 and 45'. The ball valve means is driven by foot actuated hydraulic driving means 52 through driving member 50. The balls have openings 46' and 48' through them respectively. The hydraulic drive means 52 is actuated by the hydraulic time delay flush valve generally designated by numeral 52' in the control system 14. The driving member 50 includes shaft 54 that is connected to the ball valve means 46 and 48 by linkage 54'' and 54'''.

Figure 2:
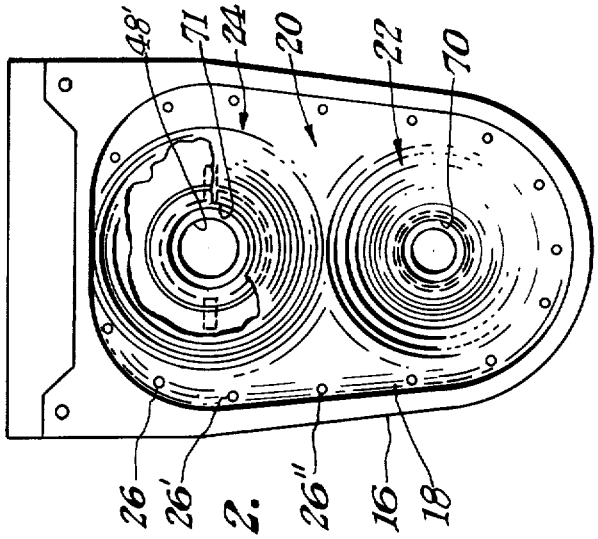
FIG. 2 is a top view of the toilet.

Piston 56 is actuated by a measured quantity of water from drive means 52 through pipe 67. The piston 56 is connected to arm 54 to drive linkage arms 54' and 54''' in order to rotate the ball valves from a position as shown in FIG. 1 to a position in which the upper opening of each ball valve is no longer viewable as shown in FIG. 2. This second position, not shown in FIG. 1, is the closed position and does not allow any material to flow through the ball valve nor does it allow any material in the grinder to be thrown back up through the ball valve up into the toilet bowl. When the ball valves are rotated to the second angular position in which the generally longitudinal center line of the opening is generally displaced 45° to 90°, depending on the size of the toilet bowl opening and the valve openings, from the position shown in FIG. 1. The outside casing 70 and 71 acts as a closure mechanism for the ball valve opening.

One portion of driving member 50 may include the piston chamber 58 for movement of piston 56. In one embodiment as the fluid chamber is filled with a measured quantity of water the valves 46 and 48 are actuated. Upon completion of the flow of water from hydraulic driving means or valve 52 the piston 56 is moved to the left, driving the piston 56 through chamber 58. The water in chamber 58 increases in pressure and is also driven through line 65 into line 28 and out through the nozzles 26, 26' and 26''. This quantity of water may be left on top of closed valves 46 and 48 as a seal. A spring or a solonoid with coils 72 and core 59 may be used to drive the piston 56 to the left. A time delay switch 59' may be used to actuate the solonoid when switch 59'' is actuated by flange or linkage projection 54' when flange 54' moves to the left. A spring may be used to move shaft 54 to the left.

When hydraulic drive means 52 is actuated a fixed quantity of water is allowed to flow from the water inlet 66 through line 67 to fill the chamber 58 and out through line 65. Between conduit 65 and conduit 28 is an adjusting valve 60. The water passes through conduit 65 and through the adjusting valve 60 into conduit 28 and out through the nozzles 26, 26' and 26''. The adjusting valve is a common, ordinary adjusting valve to meter the amount of flushing fluid mixed with the water from conduit 65. The flushing fluid from reservoir 62' moves through line 62 into the adjusting valve 60.

Regulation valve 60 is necessary to regulate the mixture of flushing fluids with water, especially when a quantity of water is fed directly from the water pressure line. It is well known that city water pressure lines vary in the amount of pressure distributed at various distribution points. Water systems throughout the United States vary in reference to the quality of the water, the hardness of water and other significant factors. The adjusting valve 60 may be utilized to keep the detergent-lubricating materials for the proper balance.

The linkage 54 can be so aligned as to permit closing of ball valves 46 and 48 before the complete discharge from spray jets 26. This will permit a small amount of flushing liquid to remain at bottom of bowl unit to prevent waste from adhering to bowl on subsequent use.

In use the time delay flush 52' is first actuated to hydraulically actuate the control system. The fluid then flows for a period of time (controlled by the time delay) to flush the bowls, and to actuate valve 50 to drive arm 54. The fluid flows through 65 through valve 60 and the nozzles to wash the bowls. The movement of arm 54 to the right as shown in FIG. 1 opens ball valve means 46 and 48. Arm 54, through cam 78, actuates electrical switch 74 as it moves to the right to power and drives the grinder and pump for a period of time allowed by time delay means 75. Arm 54, through cam 54', activates switch 59 and time delay switch 59' to move arm 54 back to the left after a period of time. When the arm 54 and the piston are driven to the left, a sealing quantity of fluid is driven into the bowl after the flushing water is deactivated by the time delay flush.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A human waste disposal system comprising:

a toilet means including a solid waste toilet bowl means and a liquid waste toilet bowl means, a low volume flushing means connected to said toilet means, said low volume flushing means including fluid flushing nozzle distribution means connected to the upper portion of said toilet means, a grinding and transfer mechanism connected to an outlet at the bottom of said solid waste toilet bowl means to provide movement of gravity feed waste into a first transfer conduit means, said first transfer conduit means connected to said grinding and transfer mechanism, a first storage means connected to said first transfer means, a water inlet and an additive means inlet connected to said low volume flushing means, a metering means including inlets and an outlet, said metering means connected to both said water inlet and said additive means inlet to distribute water and additive out through said metering means outlet, and a fluid flushing conduit connected to an outlet of said metering means, said fluid flushing conduit having an outlet and connected to said fluid flushing nozzle distribution means.

2. A human waste disposal system as set forth in claim 1 including:

a first valve means connected between said outlet of said solid waste toilet bowl means and said grinding and transfer mechanism and a second valve means connected between said outlet of said liquid waste toilet means and a second conduit means, said second conduit means connected to an outlet at the lower portion of said liquid waste toilet means, and a second storage means.

3. A human waste disposal system as set forth in claim 2 including:

a control means including a water control mechanism for controlling the distribution of water into said metering means, additive reservoir means connected to said additive means inlet, for supplying detergent-lubricating material.

4. A human waste disposal system as set forth in claim 2 wherein:

said flushing means distributing a few ounces of flushing agent, that includes water and additive, said toilet means includes an intermediate wall separating solid waste toilet bowl means and said liquid waste toilet bowl means, said fluid flushing nozzle distribution means including a plurality of nozzles placed around the upper edge of said toilet means having nozzle openings directed towards the sides and the opposite side of the said solid waste toilet bowl means and said liquid waste toilet bowl means to flush both toilet bowl means on opposite sides of said intermediate wall.

said fluid flushing nozzle distribution means being a plurality of spray nozzles, said first and second transfer conduit and storage means each including a conduit connected to a remote storage container having an air vent outlet, said grinding and transfer mechanism including an electrically operated grinding and pumping means for grinding solid waste material and for pumping the ground solid waste material through said second conduit and storage means.

5. A human waste disposal system comprising:

a toilet means including a solid waste toilet bowl means and a liquid waste toilet bowl means, said toilet means including an intermediate wall separating said solid waste toilet bowl means and said liquid waste toilet bowl means, a low volume flushing means connected to said toilet means, said low volume flushing means including fluid flushing nozzle distribution means connected to the upper portion of said toilet means, said low volume flushing means distributing a few ounces of flushing agent that includes water and additive, said fluid flushing nozzle distribution means including a plurality of nozzles placed around the upper edge of said toilet means having nozzle openings directed towards the sides and the opposite side of the said solid waste toilet bowl means and said liquid waste toilet bowl means to flush both toilet bowl means on opposite sides of said intermediate wall, said fluid flushing nozzle distribution means being a plurality of spray nozzles, a grinding and transfer mechanism connected to an outlet at the bottom of said solid waste toilet bowl means to provide movement of gravity feed waste into a first transfer conduit means, said first transfer conduit means connected to said grinding and transfer mechanism, a first storage means connected to said first transfer conduit means, a water inlet and an additive means inlet connected to said low volume flushing means, a metering means including inlets and an outlet, said metering means connected to both said water inlet and said additive means inlet to distribute water and additive out through said metering means outlet, a fluid flushing conduit connected to an outlet of said metering means, said fluid flushing conduit having an outlet and connected to said fluid flushing nozzle distribution means, a first valve means connected between said outlet of said solid waste toilet bowl means and said grinding and transfer mechanism, a second valve means connected between said outlet of said liquid waste toilet means and a second conduit means, said second conduit means connected to an outlet at the lower portion of said liquid waste toilet means and a second storage means, said first and second transfer conduit and storage means each including a conduit connected to a remote storage container having an air vent outlet, said grinding and transfer mechanism including an electrically operated grinding and pumping means for grinding solid waste material and for pumping the ground solid waste material through said second conduit and storage means, a control system including a valve actuating means, said valve actuating means connected to said first and second valve means by an arm means for simultaneously opening and closing said first and second valve means, said arm means is actuated by a hydraulic drive means, a said valve actuating means further including a water control mechanism for controlling the distribution of water into said metering means, and an additive reservoir means connected to said additive means inlet for supplying detergent-lubricating material.

* * * * *